United States Patent [19]

Yoshino

[11] 4,392,748

[45] Jul. 12, 1983

[54] QUARTZ CRYSTAL WATCH

[75] Inventor: Masahito Yoshino, Suwa, Japan

[73] Assignee: Kabushiki Kaisha Suwa Seikosha, Tokyo, Japan

[21] Appl. No.: 204,730

[22] Filed: Nov. 6, 1980

[30] Foreign Application Priority Data

Nov. 6, 1979 [JP] Japan ..... 54-143580

[51] Int. Cl.[3] ..... G04C 23/02; G04B 37/00

[52] U.S. Cl. ..... 368/88; 368/157; 368/76

[58] Field of Search ..... 368/76, 80, 107, 203, 368/204, 260, 157, 159, 160, 220, 221, 223, 228, 185, 77, 88

[56] References Cited

U.S. PATENT DOCUMENTS

| | | | |
|---|---|---|---|
| 2,974,474 | 3/1961 | Wegner | 368/204 |
| 3,691,753 | 9/1972 | Kurita | 58/23 R |
| 4,086,753 | 5/1978 | Tsuchiya et al. | 368/156 |
| 4,087,957 | 5/1978 | Miyasaka et al. | 368/204 |
| 4,177,631 | 12/1979 | Yamada et al. | 368/76 |
| 4,228,389 | 10/1980 | Vennard | 368/88 |

*Primary Examiner*—Bernard Roskoski

*Attorney, Agent, or Firm*—Blum, Kaplan, Friedman, Silberman & Beran

[57] ABSTRACT

A quartz crystal analog watch has a circuit block and mechanical elements on one side of a frame plate and the battery power source resting on an insulating plate on the other side of the frame plate. The diameter of the movement approximates the battery diameter.

28 Claims, 16 Drawing Figures

FIG. 1
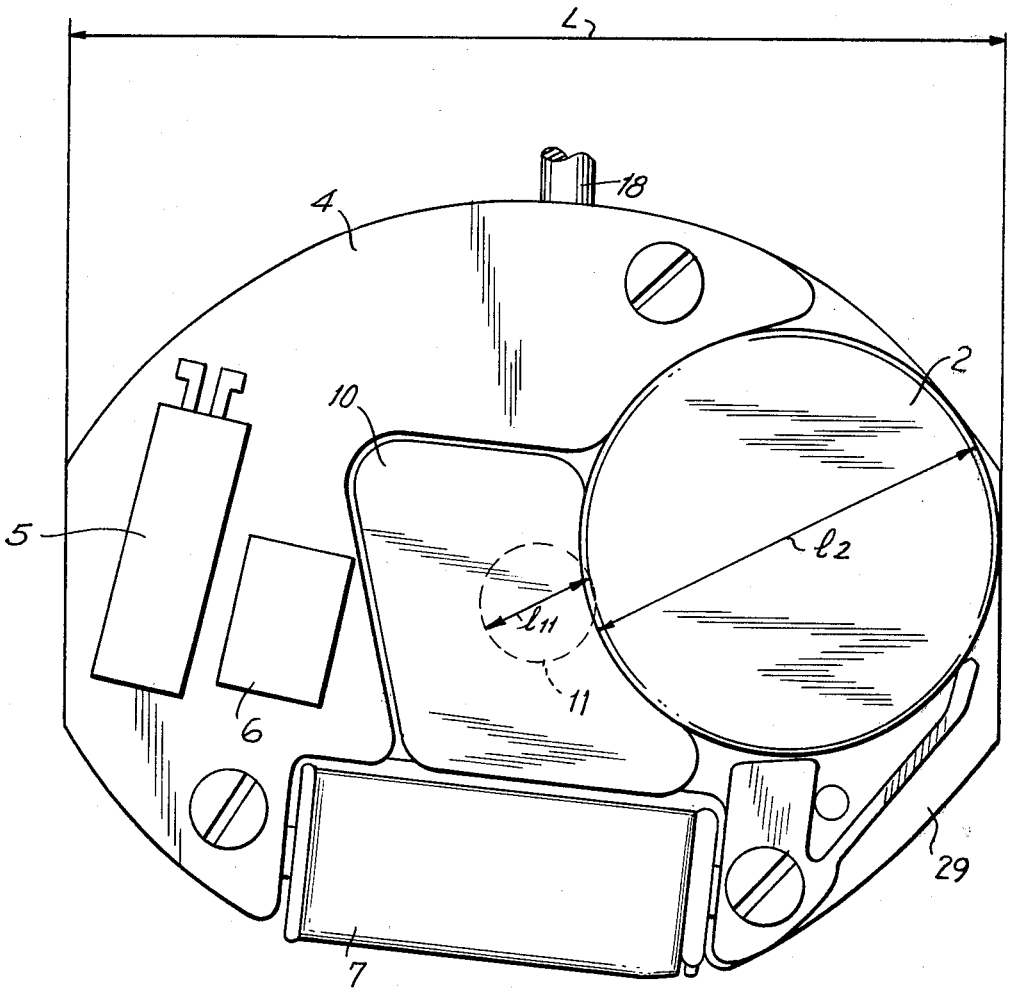
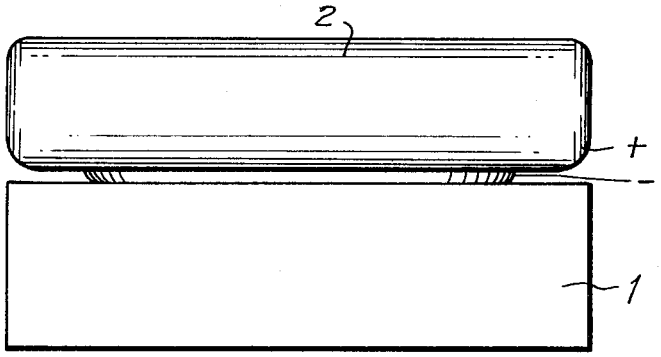
FIG. 2

FIG. 12
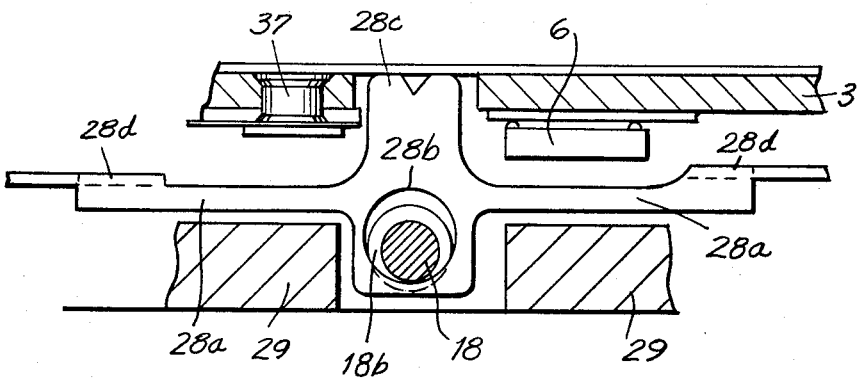
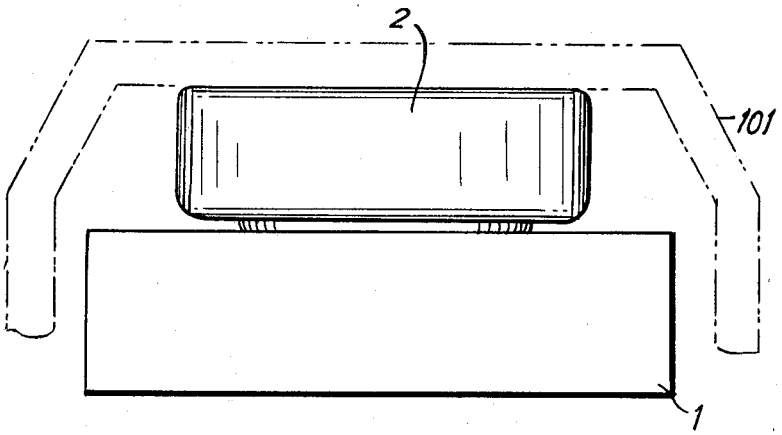
FIG. 14
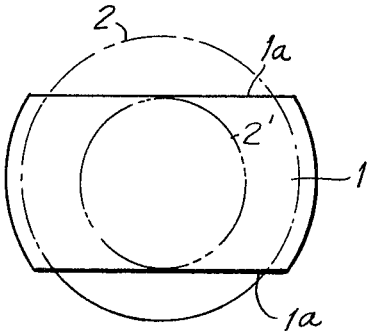
FIG. 15

QUARTZ CRYSTAL WATCH

BACKGROUND OF THE INVENTION

This invention relates generally to a quartz crystal watch powered by a self-contained battery, and more particularly to a quartz crystal watch which is made small by placing the battery on the opposite side of a frame plate from the remainder of the movement including a circuit block and mechanical elements. It is especially desirable to produce an analog display quart crystal watch which is thinner and smaller in size. Particularly, ladies watches are most desirably made very small. Also, a plurality of plan or face sizes are desirable for ladies watches to accommodate a wide range of taste and appearance. In order to meet such a requirement using a common movement, it is most necessary that the size of the movement itself be made small.

In the prior art, parts of the movement and a battery were laid out horizontally, that is, substantially in the same plane in a quartz crystal watch. As a result the longer dimension as seen in the face or plan view had to be approximately twice as long as the diameter of the battery. There has been a small-sized watch, as a very special construction, where the battery and the gear train overlap each other partially as seen in a plan view. However, in such a watch, the electronic circuit block and the battery were still positioned in substantially the same plane and separated one from the other. As a result the size of the movement was reduced so that the longest face dimension was approximately 1.4 times as long as the diameter of the battery.

What is needed is a quartz crystal analog watch having a face diameter substantially equalling the diameter of the battery.

SUMMARY OF THE INVENTION

Generally speaking, in accordance with the invention, a quartz crystal watch especially small in size is provided. The analog watch has a circuit block including MOS integrated circuits and a quartz crystal oscillator as a time standard source. The watch also includes mechanical elements, namely, a motor for converting the electrical signals generated from the circuit block into mechanical motion and a gear train for transmitting the motion of said motor to a display comprised of indicating hands. The circuit block and mechanical elements are mounted on one side of a frame plate and a battery power source, resting on an insulating plate, is located on the other side of the frame plate. The diameter of the movement approximates the battery diameter. Holes in the frame plate permit a pass-through of electrical connections, and the insulating plate prevents a short circuit between the positive and negative terminals of the battery. Positioning of the battery in an independent plane leaves ample room on the other side of the frame plate for the mechanical elements and electronic circuit block.

Accordingly, it is an object of this invention to provide an improved quartz crystal watch having the battery located on the opposite side of the frame plate from the remainder of the movement.

Another object of this invention is to provide an improved quartz crystal watch wherein the diameter of the movement substantially equals the diameter of the battery and the watch is extremely small sized.

A further object of this invention is to provide an improved quartz crystal watch powered by a battery wherein there is no possibility that the opposite poles of the battery will be shorted together.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a plan view of a conventional small-sized quartz crystal watch of the prior art;

FIG. 2 is an outline elevational view of a quartz crystal watch in accordance with this invention;

FIG. 4-B is view similar to FIG. 4-A of an alternative embodiment of a watch in accordance with this invention;

FIG. 12 is a side view of the clicking mechanism of FIG. 9;

FIG. 14 is an outline drawing of a quartz crystal watch in an alternative embdiment of this invention; and FIG. 15 is another alternative embodiment of a quartz crystal watch in accordance with this invention.

DESCRIPTION OF THE PREFERRED EMBODIMENTS

Figure 3:
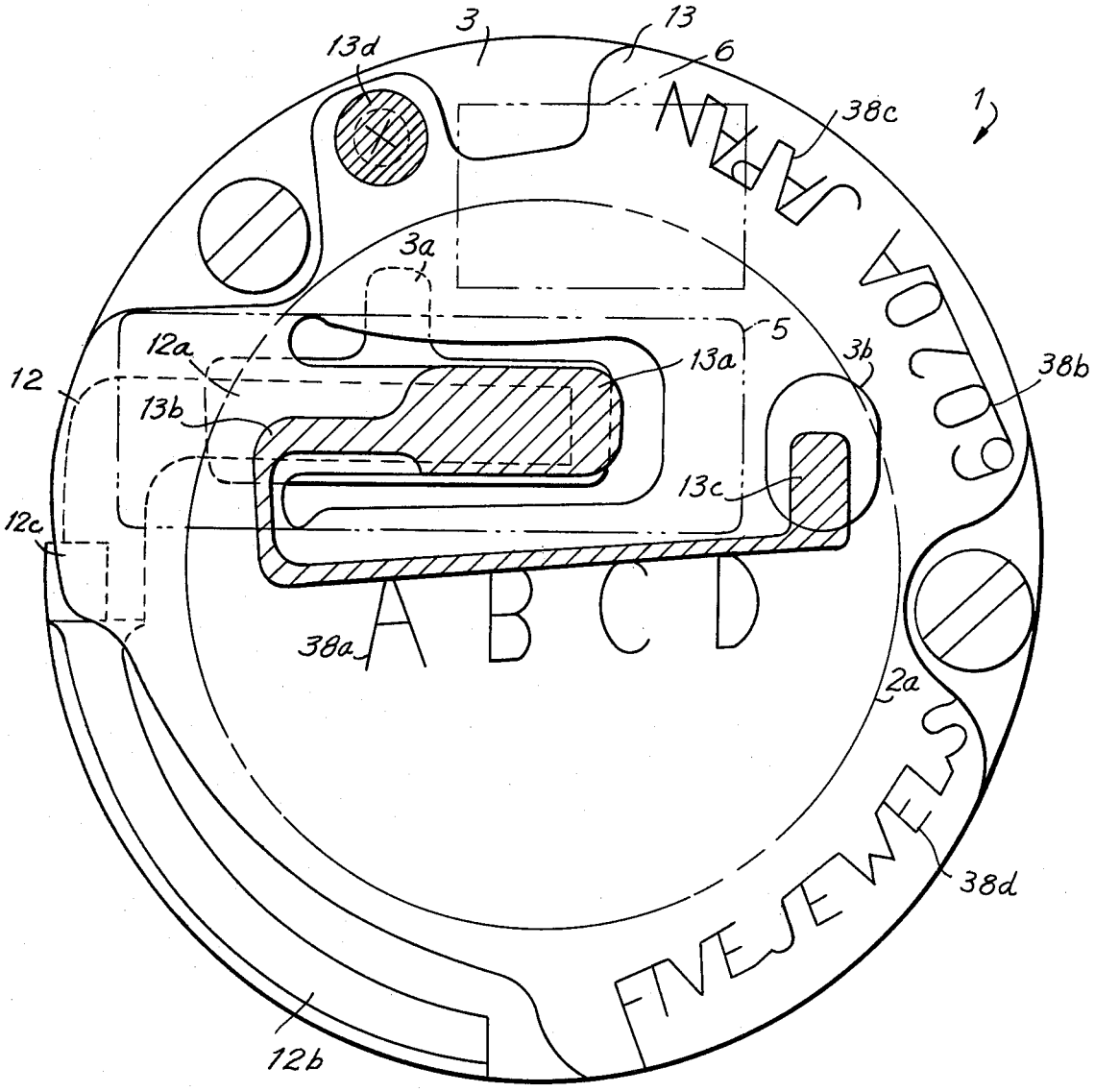
FIG. 3 is a plan view of a quartz crystal watch in accordance with this invention.

A representative plan view of a conventional quartz crystal watch of the prior art is shown in FIG. 1. A circuit block 4 includes a quartz crystal vibrator package 5 and an MOS integrated circuit 6 and the well-known step motor including a coil 7, a stator and rotor. A gear train block 10 for transmitting the motion of the rotor to an analog display having hands (not shown) is positioned so that all of the aforementioned elements are separated as seen in the plan view of FIG. 1. In this arrangement, when the diameter of a battery 2 is $l_2$, and the diameter of a center wheel 11 is $l_{11}$, then the long dimension or length L of the movement is approximately $2l_2+l_{11}$. In a typical embodiment of FIG. 1, $L=15.5$ mm, $l_2=6.8$ mm and $l_{11}=2.2$ mm. Thus, in such a typical layout, the length L of the movement is approximately a bit more than twice the diameter of the battery 2. It is very difficult to make the watch smaller in its longer dimension L than such a size.

The quartz crystal watch in accordance with this invention overcomes this limitation and provides an extremely small-sized quartz watch.

FIG. 2 shows an elemental conceptualization of this invention in outline. A battery 2 is disposed on top of a movement block 1. The outer diameter of the movement block 1 is approximately equal to the outer diameter of the battery 2. When the battery 2 is smaller than the outer diameter of the movement block 1, the centers of both 1, 2 are best positioned substantially coaxially. The efficiency in space utilization becomes very high from the point of view of movement layout by completely separating the battery from the movement block 1. In FIG. 1, a crescent-shaped area bounded by the external form of the battery and that of a baseplate 29 is wasted space which is rarely utilized.

FIGS. 3 to 13 show views of an embodiment of a quartz crystal watch in accordance with this invention wherein an effective reduction to practice is achieved. In this embodiment, an extremely small-sized movement 1 with a battery 2 having an outer diameter of 6.8 millimeters and with a baseplate having an outer diameter of 6.8 millimeters is produced. The diameter of a conventional prior art watch of the smallest size was approximately 10 millimeters. Thus, it is apparent that a movement 1 in accordance with this invention is really very small by comparison, and this invention achieves the objective of small size.

Figure 4A:
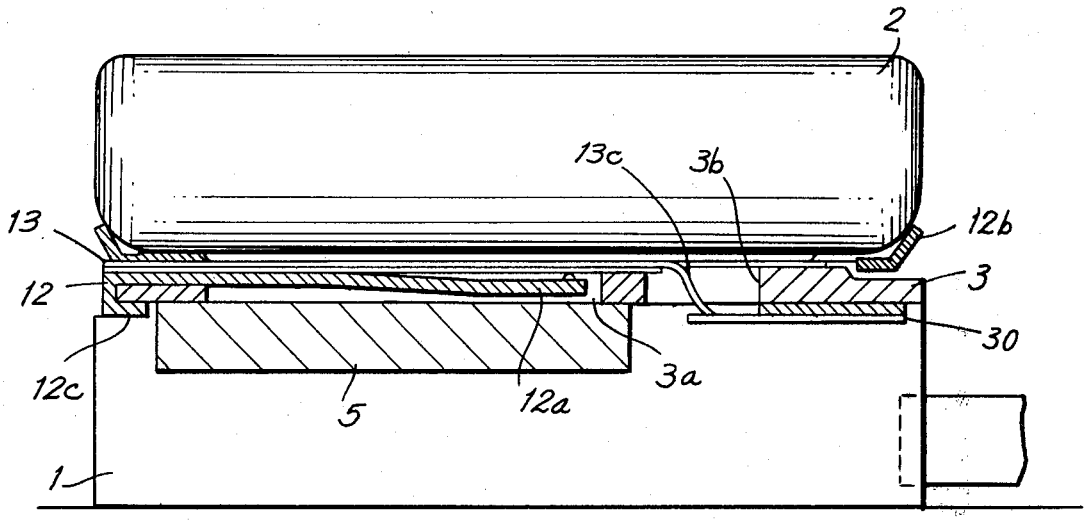
FIG. 4-A is a side elevational view, partly in sections and to a smaller scale, of the watch of FIG. 3.
Figure 4B:
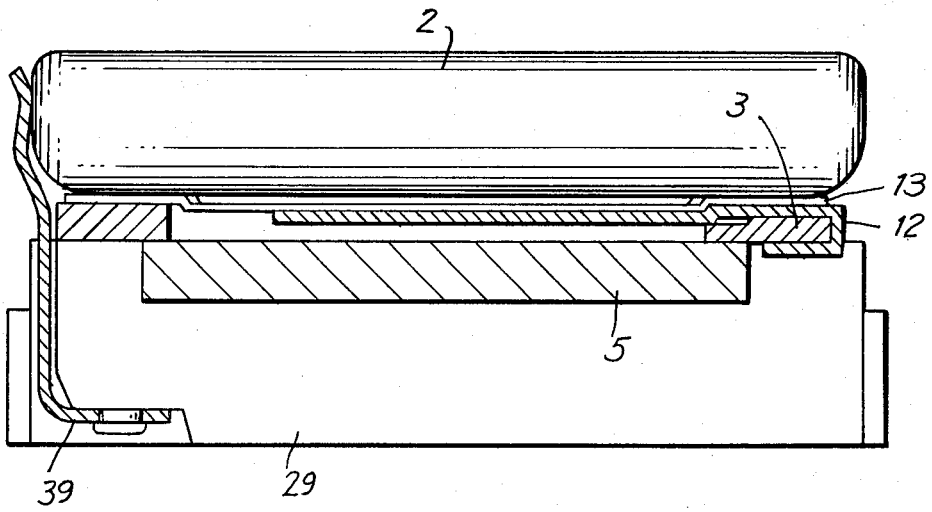

FIG. 3 is a plan view of the movement block 1 with the battery 2 removed. A battery lead plate 12 is positioned on a frame plate 3 and a battery insulating plate 13 is positioned on top of the lead plate 12. (FIG. 4-A). A resilient portion 12*a* of the battery lead plate 12 is within an aperture 3*a* provided through the frameplate 3. The insulation plate 13 includes an extended or tongue-shaped portion 13*a* having contours so as to overlay the resilient portion 12*a* of the battery lead plate 12. A pattern 13*b* for the negative lead to the battery 2 is formed on the tongued portion 13*a* and lies within the boundries of the negative pole on the battery 2, that is, within the area shown by a broken circle line 2*a* in FIG. 3. In other words, the portions 13*a, b, c* are opposite to i.e. facing the negative pole of the battery when the battery is in place. By using such a construction, the risk that the negative lead pattern will short circuit to the positive lead pattern is eliminated.

The battery lead plate 12 includes the resilient portion 12*b* for connection with the positive terminal of the battery 2 and also includes the resilient part 12*a*. It should be noted that the negative terminal of the battery 2 is the lower protrusion (FIG. 2) while the side of the battery 2 is at a positive potential. The resilient portion 12*b* for connection with the positive terminal of the battery is located on the periphery of the movement 1, that is, on the outside of the broken circular line 2*a* shown in FIG. 3 to define the negative terminal of the battery. The battery lead plate 12 is calked, that is, has a gripping portion 12*c* so that the battery lead plate 12 is held to the frame plate 3. Connection of the negative lead to the negative terminal of the battery 2 is assured by pressing the pattern 13*a, b* against the pole of the battery 2 using the force of the resilient portion 12*a* of the battery lead plate 12. The resilient portion 12*a* pushes in the plane of FIG. 4-A and thereby assures a good contact between the pattern 13*a, b* and the battery negative pole. The pattern 13*a, b, c,* shown with diagonal lines in FIG. 3 is a thin layer of copper foil formed on the battery insulating plate 13.

The battery lead plate 12 can also be fixed to the frame plate 3 by driving pins through the plate 12 into the plate 3. A circuit board 30 is positioned on the opposite side of the frame plate 3 from the battery insulating plate 13. A connection between the circuit board 30 and the negative pole of the battery 2 is completed by the copper foil pattern 13*a, b, c* through an aperture 3*b* provided in the frame plate 3. The overlaid copper foil 13*c* is welded to the circuit board 30 which also has terminals formed on the surface.

The resilient portion 12*a* of the battery lead plate 12 is also positioned within a hole 3*a* provided in a portion of the frame plate adjacent to the position where the quartz crystal vibrator package 5 is located. It should be noted that the frame plate 3 is thinner on the left side (FIG. 4-A) such that when the battery 2 is combined with the movement 1, the thickness of the battery lead plate 12 does not add to the thickness of the entire assembly, of either the battery or movement portions. Because the battery insulation plate 13 is located between the battery 2 and the frame plate 3, there is no possibility that the negative pole of the battery 2 and the frame plate 3 will be shorted together. In other words, the frame plate 3 need not serve as a source of battery potential, negative or positive, for the circuit block 30 or any other elements requiring connection to the battery. As seen in the plan view (FIG. 3), the negative potential of the battery 2, and within the movement 1, is confined within the broken circle 2*a*. As best seen in FIG. 4-A, the battery 2 and its positive surface rests in contact with a resilient portion 12*b* and thus, a connection to the positive pole of the battery 2 is obtained.

With this structure, it is possible that the outer diameter of the movement 1 is equal to or smaller than the diameter of the battery 2. Thus, the smallest possible movement diameter can be obtained. FIG. 4-B shows an alternative construction for connection with the positive pole of the battery 2. In this embodiment, a positive lead plate 39 is fixed to the backside of a baseplate 29 and touches resiliently against the side of the battery 2. As stated above, the side of the battery has a positive polarity. It should also be understood that the resilient member 12*b* giving pressure for contact can be fixed directly to the frame plate 3 or to the baseplate without providing any special insulating means because the means for applying pressure for connection with the negative pole and the connecting leads are provided independently of each other. Thus, the structure is free of limitations of materials for such members as the frame plate 3 and baseplate. These elements 3, 29 need not form a part of the electrical circuits. Further, as shown in FIG. 4-A, the resilient member 12 is used for making contact to the positive battery terminal as well as for applying pressure which makes contact for the copper foil 13*a*. The battery insulation plate 13, as seen in FIG. 3, can also be used for labeling by using copper foil patterns. As shown, the name of a manufacturer ABCD is displayed within the locus of the negative pole of the battery 2, namely, within the broken line 2*a*. The identification of the model, the number of jewels in the mechanical movement, and the like, are indicated outside the broken circle line 2*a*. Since the marks are completely separated, outside and inside the locus of the negative pole of the battery 2, there is no danger of a short circuit when a pattern for connections is also utilized as markings. Such a location for the markings has an advantage in that it is immediately below the battery 2 and readily visible when the battery is removed. The battery insulating plate 13 for isolating the battery 2 is fixed to the frame plate 3 by an extending tab portion 13*d* of copper foil and then by welding the foil directly onto the frame plate 3. However, it should be understood that the means of fixing the insulating plate 13 in position need not be restricted only to the above-described construction. The insulating plate 13 can be positioned by means of a pin fixedly holding the plate 13 to the frame plate 3 or, the insulating plate 13 can be held in place when the battery is put into position with only a pin being used to locate the insulating plate 13 relative to the frame plate 3.

Figure 5:
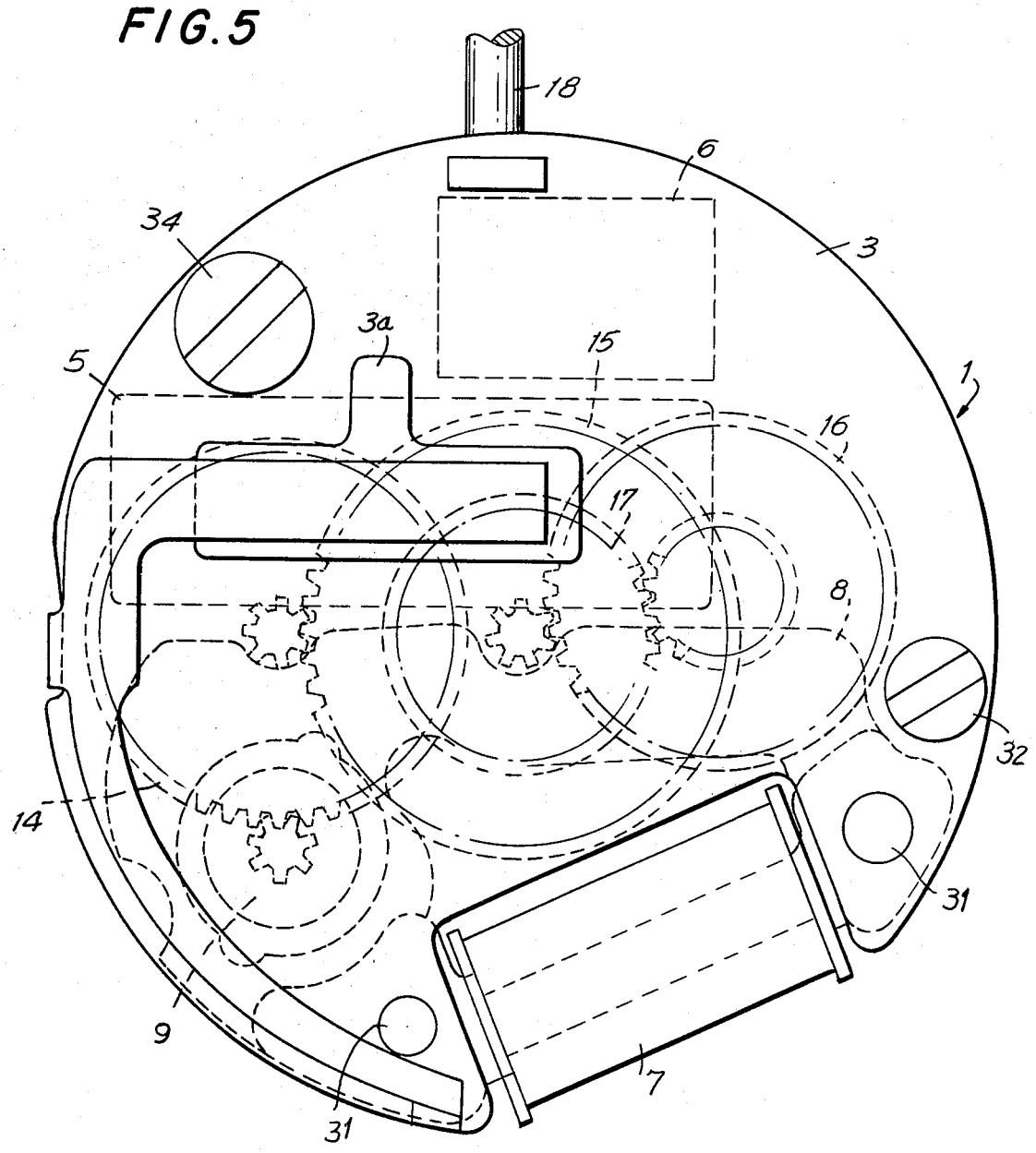
FIG. 5 is a plan view of the movement of the watch of FIG. 3.
Figure 6:
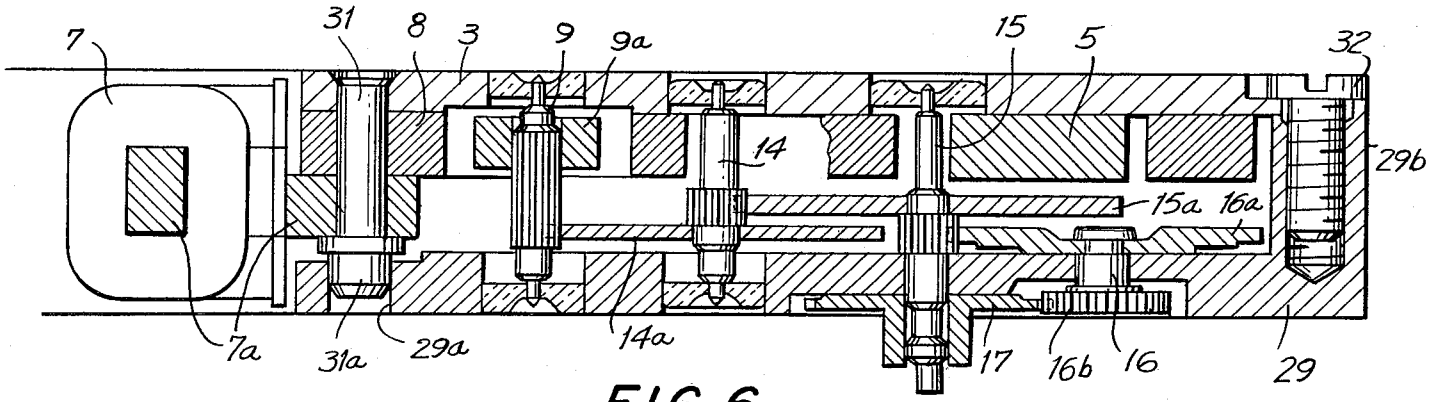
FIG. 6 is an elevational sectional view of the motor and gear train of the watch of FIG. 3.
Figure 9:
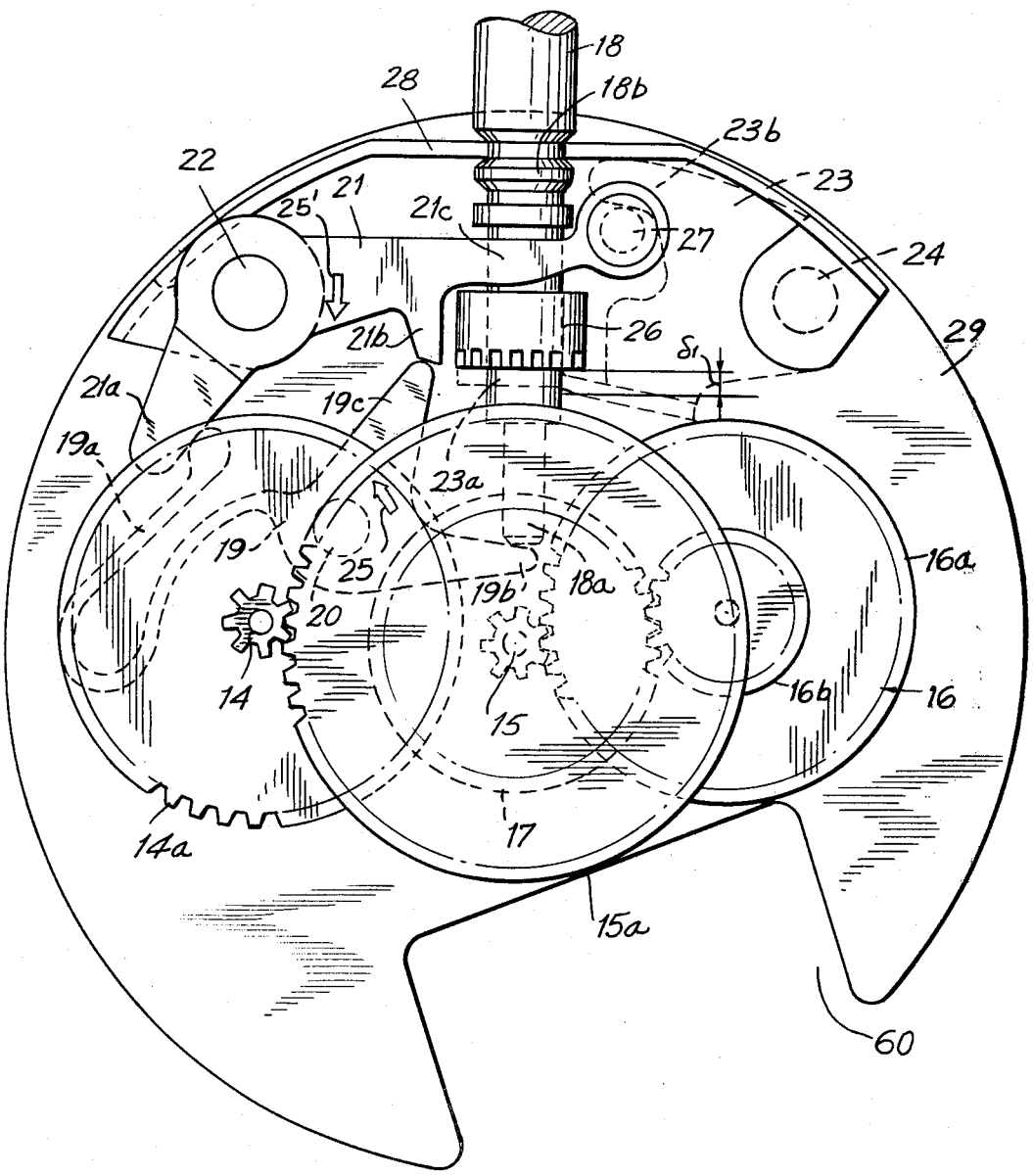
FIG. 9 is a plan view of the setting mechanism for the watch of FIG. 3.

FIG. 5 is a plan view similar to FIG. 3. However, in FIG. 5, the insulating plate 13 for the battery 2 is removed from the movement block 1 so that further details of construction are exposed to view. The setting portion of the mechanical structures is omitted in FIG. 5 but is shown in FIG. 9 which is described hereinafter. A quartz crystal vibrator package 5 and a MOS integrated circuit 6 are positioned above the center of the movement 1 (FIG. 6). The quartz crystal vibrator package 5 is located in such a position that it almost covers the entire aperture 3*a* provided in the frame plate 3. A conventional step motor is comprised of a coil 7, stator 8, and rotor 9. In the known manner, the step motor serves as a convertor from electrical signals to mechanical motion for a quartz crystal watch. An intermediate wheel 14 transmits the movement of the rotor 9 to a center wheel 15. A minute wheel 16 connects to the center wheel 15 and transmits the motion to an hour wheel 17 which is coaxial with the center wheel 15. A winding stem 18 serves as an external operation member as described hereinafter. The intermediate wheel 14, center wheel 15 and the hour wheel 17 have their centers positioned substantially along a line at a right angle to the longitudinal axis of the winding stem 18. The stator 8 is the quartz crystal vibrator package 5 are also substantially at a right angle to the winding stem 18. Further, the wheels 14, 15, 16 overlap the quartz crystal vibrator package 5 and the stator 8 (FIG. 5), and the stator 8 and the quartz crystal vibrator package 5 are arranged so that they lie between the MOS integrated circuit 6 and the coil 7.

In this construction, the constraints on the size of the wheels of the gear train are rather low in view of the size of the movement, and so a relatively larger gear train can be used. As a result, it is possible to develop larger watch models in spite of the small movement within, without concern for hand deflection. Thus, a rich variety of commercial products is possible from such a small movement defined substantially by the diameter of the battery. In the embodiment of FIGS. 3, 5, the proportion of the plan area taken up by the intermediate toothed wheel 14, the center toothed wheel 14, the center toothed wheel 15 and the minute toothed wheel 16 in the movement amounts to only 33 percent.

By adopting a structure where the stator 8 and the quartz crystal vibrator package 5 are arranged parallel to each other in a nearly central portion of the movement, and with the MOS integrated circuit 6 and the coil 7 disposed on opposite sides of the stator 8 and vibrator package 5, it is possible to completely separate the coil 7 from the setting portion of the watch where there are moveable elements and a large plan area is necessary. The coil has substantially the same thickness as the thickness of the entire movement 1. This separation of the coil 7 and setting portions contributes to an increase in the efficiency of utilization of the entire space. In particular, the components for the setting mechanism can be easily positioned on both sides of the winding stem 18 when the coil is not in the vicinity.

FIG. 6 is a sectional view of the motor and gear train assemblies. The motor includes the coil 7, a coil core 7*a*, and the stator 8. The quartz crystal vibrator package 5 is also visible. The stator 8 and the coil core 7*a* are fixed to the frame plate 3 by a pin 31 with the stator 8 being on the inside of the frame plate 3. An end 31*a* of the pin 31 is engaged with a hole 29*a* provided in the baseplate 29, and the position of the frame plate 3 with respect to the baseplate 29 is fixed by engagement of this end 31*a*. The rotor 9 includes a magnet 9*a* and rotation of this rotor 9 is transmitted to the center wheel 15 through the intermediate wheel 14. Then, the movement of the center wheel 15 is transmitted to the hour wheel 17 through the minute wheel 16.

One end of the frame plate 3 is fixed directly to the baseplate 29 by an integral boss 29*b* which has a threaded hole for receiving a screw 32. The upper and lower tenons of the wheels 9, 14, 15 are supported for rotation by bearings. That is, the upper tenon of the center wheel 15 is supported by a bearing made of hard stone, that is, a jewel.

The center of rotation of the minute wheel 16 is within the overlapping periphery of the center toothed wheel 15*a* and is held with the baseplate 29 being between the minute toothed wheel 16*a* and the minute pinon 16*b*.

As shown in FIGS. 3 to 6, the battery 2 is disposed on one side of the frame plate 3 and the motor, comprising the stator 8, coil 7 and rotor 9, and the circuit block comprising the quartz crystal vibrator package 5 and MOS integrated circuit 6 are disposed on the other side of the frame plate 3. The toothed wheels 14*a*, 15*a*, and 16*a* are positioned between the baseplate 29 and the quartz crystal vibrator package 5, and between the baseplate 29 and the stator 8. Further, the stator 8 and the quartz crystal vibrator package 5 are positioned at almost the same elevation (FIG. 6) in the movement. With such a layout, the diameter of the movement 1 can readily be made small and the watch can also be made thinner because the wheels overlap one another efficiently.

Figure 7:
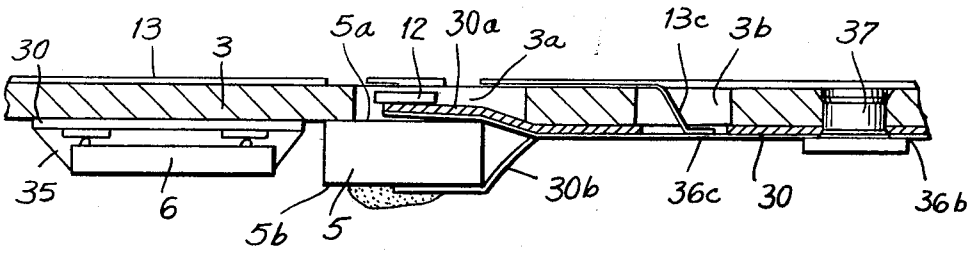
FIG. 7 is a sectional view of the circuit portion of the watch of FIG. 3.

With reference to FIG. 7, the connection of the quartz crystal vibrator package 5 to a circuit board 30 is described. In this embodiment, the quartz crystal vibrator package 5 is of the flat-packaged type having both electrodes of gate and drain on its upper and lower surfaces 5*a*, 5*b*, respectively. The quartz crystal vibrator package 5 is fixed to the frame plate 3 by means of a bonding agent. The electrode 5*a* of the quartz crystal package 5 is electrically connected by contact of the tongued portion 30*a* extending from the circuit board 30. Contact pressure between the tongued portion 30*a* and the electrode 5*a* of the quartz crystal vibrator package 5 is primarily provided by the resilience of the tongued portion 30*a*. The tongued portion 30*a* is also pressed upon by the battery lead plate 12 which adds to the pressure making contact with the electrode 5*a* of the quartz crystal vibrator package 5. Connection to the other electrode 5*b* of the quartz crystal vibrator package 5 is made by overlapping a pattern of copper foil 30*b* extending from the circuit board 30. The copper foil is soldered onto the electrode 5*b* of the quartz crystal vibrator package 5. The MOS integrated circuit 6 is mounted directly to a lead pattern provided on the circuit board 30 by means of a dielectric binding agent. This technique is called face-down bonding. Molding material 35 surrounds the MOS integrated circuit 6 in order to reenforce the integrated circuit. By using this face-down bonding method for mounting the integrated circuit 6, there is no weak point in the circuit board 30 even though the circuit board 30 is extremely thin. That is, it is not necessary to pierce the circuit board 30 for the sake of mounting the MOS integrated circuit 6.

Figure 8:
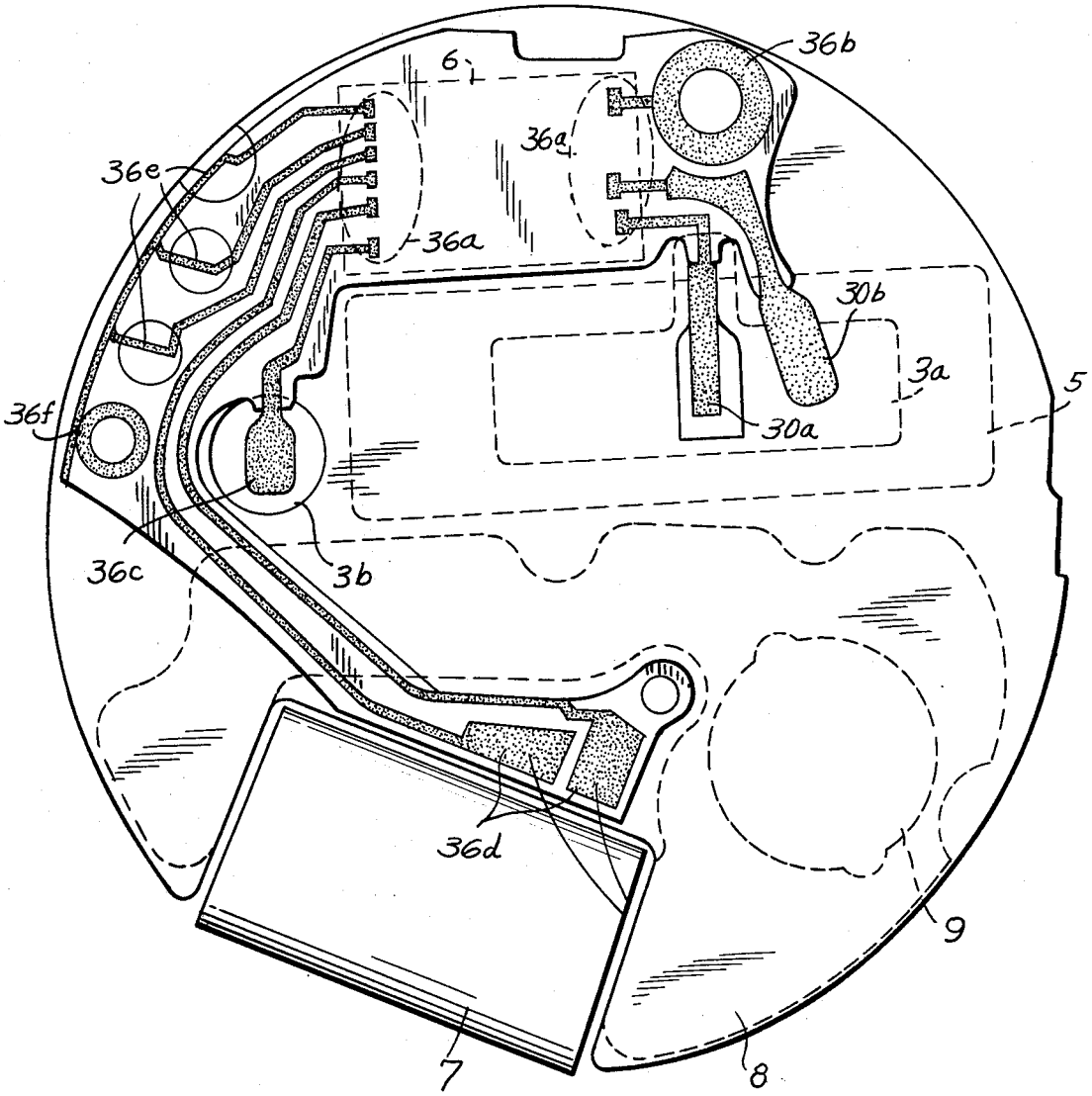
FIG. 8 is a plan view of the circuit board of the watch of FIG. 3.

In FIG. 8, the shaded portions are patterns made of copper foil which are provided on the circuit board 30. Conducting portions 30*a*, 30*b* connect to the quartz crystal vibrator package 5 as described above. Regions 36*a* include the contacts which connect with the pads on the MOS integrated circuit 6. Also included in the pattern of copper foil is a positive electrode 36*b*, a negative electrode 36*c* and a pair of driving output connections 36*d*. Broken lines are used in FIG. 8 to indicate where in an assembled structure the integrated circuit 6, vibrator package 5, rotor 9, stator 8, coil 7, and apertures 3*b* and 3*a* are located. The negative terminal 36*c* overlaps the aperture 3*b*. Terminals 36*e* are provided for logic regulation which is done by cutting the portions 36*e*. A terminal 36*f* is connected to the positive pole through a pin in the same manner that positive terminal 36*b* is connected through a pin 37. (FIG. 7).

The positive connection 36*b* is driven into the frame plate 3 by means of the pin 37. The negative connection 36*c* is fixed to the overlapped portion 13*c* of the negative lead pattern on the battery insulating plate 13 by means of welding or the like. The terminals of the coil 7 are connected with driving output connections 36*d* by soldering, pressure welding, or the like. These driving output connections 36*d* are positioned between the stator 8 and the coil 7 as seen in a plan view (FIG. 8).

FIG. 9 is a plan view wherein the frame plate 3 has been removed to further expose mechanical details in the movement block 1. FIG. 9 shows a state of operation where the external operational member 18, that is, the stem is pushed in, in the normal running condition. A setting lever 19, a clutch lever 21 and a lever 23 are positioned so that they rotate around a setting lever pin 20, a screw pin 22 and a fixing pin 24 respectively. The setting lever 19 includes a resilient portion 19*a* which engages with a tail portion 21*a* of the clutch lever 21. The resilient portion 19*a* provides a rotating moment in the direction of arrow 25 to the setting lever 19 and a rotating moment in the direction of arrow 25′ is applied to the clutch lever 21. An end 19*b* of the setting lever 19 engages the tip 18*a* of the winding stem 18, and the other end 19*c* of the setting lever 19 engages a portion 21*b* of the clutch lever 21. A clutch wheel 26 is positioned between one end 23*a* of the lever 23 and a portion 21*c* of the clutch lever 21.

The position of the lever 23 is restricted in one direction by engagement of the portion 23*b* with a clutch lever pin 27 which is driven transverse to the clutch lever 21. A resilient positioning member 28, which effects clicking operation and sounds, has resilience and is engaged with a click portion 18*b* on the winding stem 18 to position the stem 18 and to cause the sound and feeling of a click when the winding stem 18 is pulled out and pushed in. The resilient member 28 is fixed to the baseplate 29 by the screw pin 22 and on the other side by the fixing pin 24. A notched portion 60 is provided in the baseplate 29 and in the frame plate 3 for the coil 7 to be received therein. Resilience is provided in the extension 23*a* of the lever 23 which pushes the clutch wheel 26 toward the clutch lever 21 whereby a space $\delta_1$ is positively provided between the center wheel 15 and the clutch wheel 26.

Figure 10:
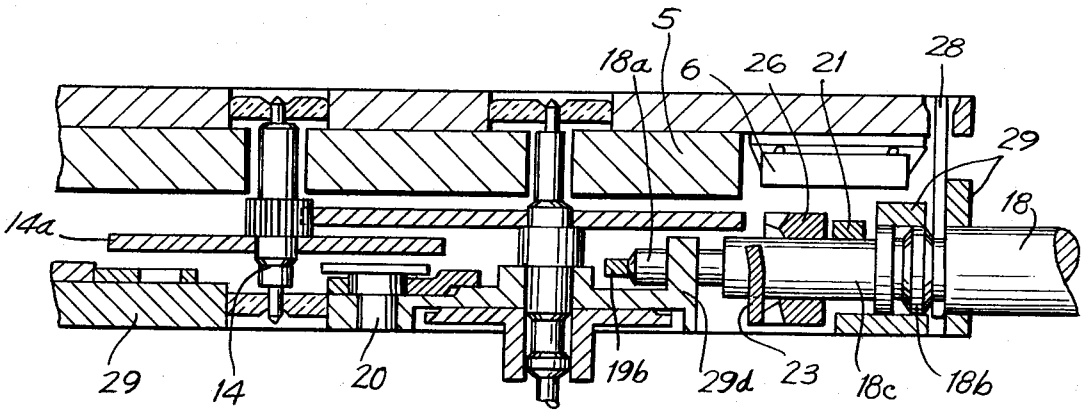
FIG. 10 is an elevational sectional view of the setting portion including the winding stem of the watch of FIG. 3.

FIG. 10 is a sectional view of the setting portion of the quartz crystal watch in accordance with this invention. In particular, the winding stem construction is shown. The click portion 18*b* of the winding stem 18 engages the resilient member 28 whereby the winding stem 18 is held in position. The winding stem has a portion 18*c* which is not circular in cross section on which the clutch wheel 26 is engaged for rotation with the stem 18. The clutch wheel 26 can translate along the length of the portion 18*c*. The lever 23 and the clutch lever 21 engage opposite faces of the clutch wheel 26 and the lateral position of the clutch wheel 26 along the winding stem portion 18*c* is determined by these two levers 21, 23.

The end 18*a* of the winding stem 18 engages the tip 19*b* of the setting lever 19. The setting lever axle 20, which is the rotational center for the setting lever 19, is positioned within the locus of, that is, overlapped by, the toothed wheel 14*a* of the intermediate wheel 14. Over the clutch wheel 26 the MOS integrated circuit 6 is positioned, and as stated above, the quartz crystal vibrator package 5 is adjacent to the integrated circuit 6. The major portion of the setting mechanism is overlapped by the quartz crystal vibrator package 5 and the MOS integrated circuit 6. The resilient member 28 is held in position by a wall of the baseplate 29.

Figure 11:
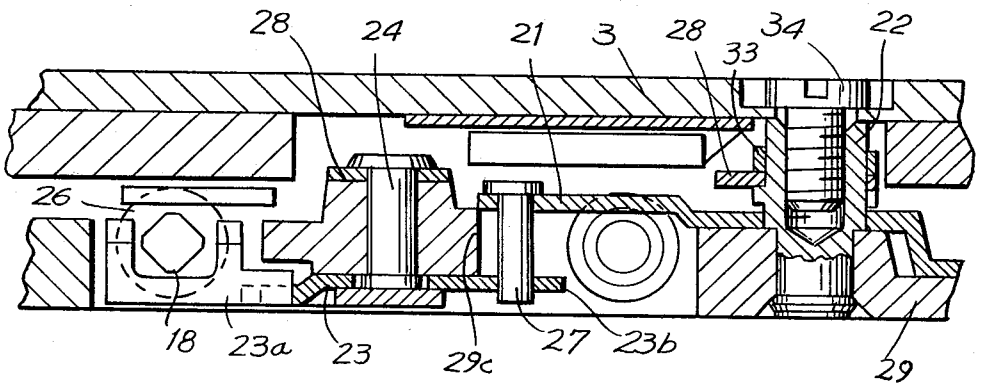
FIG. 11 is another elevational sectional view similar to FIG. 10.

FIG. 11 is a sectional view showing fixing and engaging relationships of the setting portion and in particular the positions of the levers. The clutch lever 21 is fixed to the baseplate with a screw pin 22 being its center of rotation. The resilient member 28 for clicking is fixed to the screw pin 22 by a ring 33. The frame plate 3 is fixed to the baseplate 29 by means of a screw 34 threaded into the screw pin 22. The other side of the resilient member 28 is fixed to the baseplate 29 by being contrained by one end of the fixing pin 24 which is the rotational center for the clutch lever 23. As stated above, one end 23*b* of the lever 23 engages the clutch lever axle 27 which is fixed to the clutch lever 21. The other end 23*a* of the clutch lever 23 bends to rise at a right angle and engages the clutch 26 to regulate the position along the stem 18 of the clutch wheel 26.

FIG. 12 is a more detailed partial view showing the resilient member 28 used to produce clicking. The resilient member 28 includes resilient portions 28*a*, a hole 28*b* through which the stem 18 passes with the click portion 18*b* of the winding stem engaging the hole edge. A head portion 28*c* is operated from the backside when the battery 2 has been removed from the watch. As described above, the resilient member 28 is fixed to the baseplate 29 and a portion of the resilient member 28 is bent at a right angle between the attached ends 28*d* and the resilient portion 28*a*.

At the time of attaching and detaching the winding stem 18, the head portion 28*c* of the resilient member 28 for clicking is pushed, whereby the resilient portions 28*a* are flexed. As a result, the center of the hole 28*b* substantially coincides with the center of the winding stem 18. At that time, the resilient portion 28*a* touches the baseplate 29 so that the head portion 28*c* cannot be pushed too far. Naturally, the diameter of the hole 28*b* of the resilient member 28 is slightly larger than the outside diameter of the click portion 18*b* of the stem 18.

Figure 13:
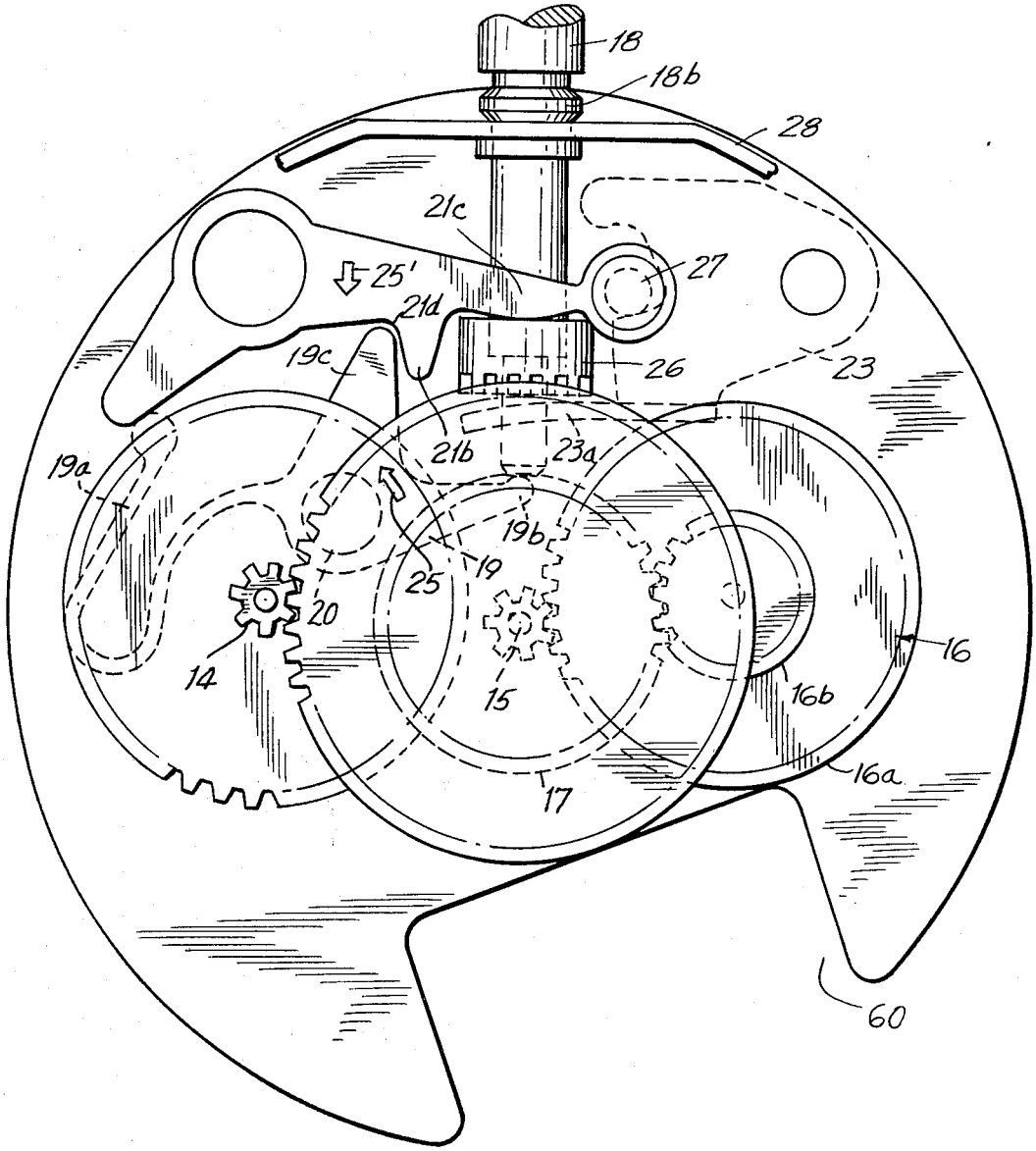
FIG. 13 is a view similar to FIG. 9 with the stem extended.

Operation of the setting portion is described hereinafter with reference to FIGS. 9 and 13. FIG. 9 is a plan view showing the setting portion when the winding stem is in the normal position for ordinary operation of the watch. FIG. 13 is a similar plan view of the watch showing the condition where the winding stem has been pulled out to a second stop position, in particular, a condition for setting of the hands.

The winding stem 18 is pulled out, that is, displaced vertically in FIG. 13 from the regular position shown in FIG. 9. The resilient member 28 for clicking slides along a sloping surface of the click portion 18*b* of the winding stem 18. When the resilient member 28 passes over a peak and drops into the following valley, the quartz crystal watch in accordance with this invention achieves the condition shown in FIG. 13 with an accompanying sound and feel of clicking. When the end 18*a* of the winding stem 18 is moved toward the outer periphery of the watch by pulling on the stem, the setting lever 19, under the influence of the resilient biasing portion 19*a*, rotates in the direction indicated by the arrow 25 by an amount equal to that which the winding stem moves back. That is, the end 19*b* maintains contact with the end 18*a* of the winding stem 18. The portion 19*c* of the setting lever 19 also moves when the setting lever 19 rotates about the axis 20. The portion 19*c* as seen in FIG. 9, serves as a stop for the clutch lever 21. When the stop 19*c* disengages from the clutch lever 21*b*, the clutch lever 21 rotates in the direction indicated by the arrow 25'. This motion is also induced by the force of the resilient portion 19*a* of the setting lever 19.

A stop for the clutch wheel 26, as shown in FIG. 13, is obtained by engaging the clutch wheel axle 27 with a portion of the baseplate 29. In FIG. 11, it can be seen that a wall 29*c* of the baseplate 29 engages with the clutch wheel pin 27. Following a rotation of the clutch lever 21 as described above, the lever 23, in engagement with the clutch wheel pin 27, also moves so as to be in the position shown in FIG. 13. The clutch wheel 26, which is located between the portion 21*c* of the clutch lever 21 and the lever portion 23*a* of the lever 23 is moved along the stem 18 to the position shown in FIG. 13. In this position, the clutch wheel 26 engages with the toothed wheel 15*a* of the center wheel 15. When the winding stem 18 is rotated with the clutch wheel 26 engaging the toothed wheel 15*a*, the clutch wheel 26 rotates and this rotation of the clutch wheel 26 is transmitted to the center wheel 15. Thereby, hand setting is accomplished. The motion of the lever 23 is constrained in one direction by the clutch lever pin 27 and in the other direction by a wall 29*d* of the baseplate 29 (FIG. 10).

Operation of the setting mechanism when pushing the winding stem 18 from its second position to its normal position is now described. When the winding stem 18 is pushed in from its second position shown in FIG. 13, the end 19*b* of the setting lever 19 is pushed by the end 18*a* of the winding stem. This causes the setting lever 19 to rotate in a direction opposite from the arrow 25 causing the other extension 19*c* to slide on the sloping surface 21*d* of the clutch lever 21, whereby the clutch lever 21 is driven to rotate in the direction opposite to the arrow 25'. Motion of the clutch lever 21 is transmitted to the lever 23 through the clutch wheel pin 27 causing the lever 23 to pivot toward the outer periphery of the movement. The portion 23*a* of the lever 23 pushes against the base of the clutch wheel 26 and drives the clutch wheel along the winding stem 18 toward the external portion of the stem. Thus, the clutch wheel 26 and the toothed wheel 15*a* of the center wheel 15 disengage from each other. By this series of motions, the interrelationship of the setting parts changes from the state shown in FIG. 13 to that shown in FIG. 9.

The setting mechanism in accordance with this invention has the following features. A first advantage lies in the fact that the components participating in the movement of the clutch wheel 26 and the components for providing the sound and feel of clicking are independent one from the other. That is, the sound and feel of clicking are provided by the resilient member 28 for clicking and the click portion 18*b* of the winding stem 18. On the other hand, the clutch wheel 26 is driven by the setting lever 19, the clutch lever 21 and the lever 23.

A second advantage is that the positioning and driving of the clutch wheel 26 are accomplished by two levers. Because of this construction, the clutch wheel 26 is made very short in length and the length of the setting mechanism which is mounted on the winding stem can be made short. In the quartz crystal watch in accordance with this invention, a much smaller size has been achieved by the development of the setting structure having the advantages mentioned above.

A third advantage lies in the fact that the clutch wheel 26 directly engages with the toothed wheel 15*a* of the center wheel 15 for setting purposes. Because of this feature, the number of components parts is much reduced and further, the movement is made much smaller. This is the primary object of this invention. With a setting wheel, or the like, as used in conventional prior art watches, the length of the setting mechanism which is cooperating with the winding stem becomes greater and as a result the movement becomes larger in size.

In the embodiment described above, a mechanical setting mechanism is utilized. Of course, an electrical hand setting mechanism can also be utilized in an alternative embodiment in accordance with this invention. Electrical hand setting methods are divided broadly into the following two categories. First, setting can be accomplished using an external crown for rotation, and second, a push button can be used for setting. When using a crown, the hands are set by rotating the crown in the condition where the winding stem is pulled out in the same manner as for the operation of a winding stem in a conventional mechanical setting mechanism. A clicking sound and sensation accompanies rotation of the winding stem and the watch is advanced or delayed by a predetermined amount of time for each click of rotation of the crown. Furthermore, the time period to be advanced or delayed by one click can be changed by changing the speed of rotation of the crown. The circuits of such embodiments are disclosed in Japanese patent application No. 54-11729 by the applicant and in Japanese patent application No. 54-11730. Japanese patent application No. 54-29748 teaches a structure for a hand setting mechanism using a crown.

In hand setting by use of a pushbutton, the watch is advanced by a fixed increment of time for each push of the button, and rapid advancement is continuously supplied when the button is kept continuously depressed. In another embodiment, two buttons are used, one for advancing the time display and the other for retarding the time display. Either concealed or conventionally visible buttons serve satisfactorily.

FIG. 14 shows an alternative embodiment of a quartz crystal watch in accordance with this invention. A battery 2 is positioned substantially, centrally on a movement block 1. The outer diameter of the movement block 1 is 9.5 millimeters and that of the battery 2 is 6.8 millimeters. In this arrangement, a sloping surface at the corners of the case back is easily provided. This beveled corner 101 is a significant factor in the appearance of the watch models. Of course, a higher capacity battery having a longer life is achieved when the battery also has a diameter of 9.5 millimeters. Such a configuration would be as shown in FIG. 2.

FIG. 15 is a plan view of another alternative embodiment of a quartz crystal watch in accordance with this invention. In this embodiment, the movement block 1 does not have a full circular shape. Rather, a pair of secant lines parallel an equi distant from the center of the circle reduce the face area of the movement block 1. The diameter of the circular portion of the movement block 1 is substantially the same as that of a large battery. The distance between the secant cuts 1*a* is approximately equal to the diameter of a small battery. Thus, the same movement 1 can be used with the larger battery to produce a watch having a long life before battery depletion. A small battery can be used when it is desired to have a watch which is an elongated rectangle as seen in the face view. A small battery is also used when it is desired to have beveled corners 101 (FIG. 14) for the case back. The movement 1 can be used for round-shaped watches as well as those having a large battery and a long battery life.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A quartz crystal watch comprising:

a movement, said movement including:

vibrator means providing a standard frequency signal;

a MOS integrated circuit having electronic circuit means for operating on said standard frequency signal and outputting signals for driving motor means;

motor means for converting said output signals from said electronic circuit means into mechanical motion, said motor means including a permanent magnet rotor, plate-type stator, and driving coil, said rotor, stator and coil not overlapping one another;

a gear train cooperating with said motor means to drive a display; and a frame plate supporting said rotor and said gear train, said MOS integrated circuit and said driving coil being positioned in approximately opposite positions on said frameplate, and said gear train being positioned between said MOS integrated circuit and said driving coil;

a battery positioned on one side of said frame plate, the area of said movement being substantially equal to the area of said battery;

an insulating plate positioned between said battery and said one side of said frame plate, said vibrator means, circuit means, motor means and gear train being positioned on the other side of said frame plate, said battery being positioned to overlap said driving coil, said MOS integrated circuit and said gear train; and a battery lead plate for connecting said battery with said MOS integrated circuit, at least a part of said lead plate being positioned in contacting opposition with an outer peripery portion of said battery, said battery lead plate supporting said battery relative to said movement and said frame plate.

2. A quartz crystal watch as claimed in claim 1, wherein said battery is circular, said movement is substantially circular, the circular centers of said battery and movement being coaxial.

3. A quartz crystal watch as claimed in claim 2, wherein the diameter of said battery and the diameter of said movement are equal, whereby a small watch may be produced.

4. A quartz crystal watch as claimed in claim 1 or 2, and further comprising at least one aperture through said frame plate and said insulating plate, and conducting means on a portion of a surface of said insulating plate, said conducting means contacting one polarity terminal of said battery and extending through said at least one aperture to connect said circuit means to said one polarity battery voltage terminal.

5. A quartz crystal watch as claimed in claim 4, wherein said battery lead plate contacts the other polarity terminal of said battery at said peripheral portion, and extends to connect said circuit means to said other polarity battery voltage terminal.

6. A quartz crystal watch as claimed in claim 5, wherein said MOS integrated circuit is mounted on a circuit board, said board having lead patterns formed on a surface thereof, and said integrated circuit and said vibrator means being connected to said circuit board, said conducting means and said lead plate connecting with separate terminals on said circuit board.

7. A quartz crystal watch as claimed in claim 1 or 3, wherein said movement further comprises mechanical setting means including a stem.

8. A quartz crystal watch as claimed in claim 7, wherein said gear train includes a plurality of interconnected wheels and pinions, said winding stem being radially oriented on said movement and the centers of said plurality of wheels being substantially on a line transverse to said stem and dividing the circular area of said movement into a first and a second portion.

9. A quartz crystal watch as claimed in claim 10, wherein said circuit means and vibrator means are in said first circular portion adjacent said stem, and said coil, stator, and rotor are in the second circular portion opposite from said stem.

10. A quartz crystal watch as claimed in claim 9, wherein said setting means are located within said first circular portion.

11. A quartz crystal watch as claimed in claim 10, wherein said plurality of wheels overlap a portion of said first circular portion.

12. A quartz crystal watch as claimed in claim 11, wherein each said wheel includes a toothed wheel, and at least one toothed wheel overlaps the rotational center of another toothed wheel.

13. A quartz crystal watch as claimed in claim 8, wherein said transverse line bisects the circular area of said movement into substantially equal portions.

14. A quartz crystal watch as claimed in claim 1 or 3, wherein said vibrator means is a quartz crystal vibrator.

15. A quartz crystal watch as claimed in claim 6, wherein said vibrator is a quartz crystal vibrator.

16. A quartz crystal watch as claimed in claim 12, wherein said vibrator is a quartz crystal vibrator.

17. A quartz crystal watch as claimed in claims 2 or 3, wherein the diameter of the battery is 6.8 millimeters.

18. A quartz crystal watch as claimed in claim 2, wherein the diameter of the movement exceeds the diameter of the battery.

19. A quartz crystal watch as claimed in claim 18, wherein said movement is the portion between two parallel secants of a circle.

20. A quartz crystal watch as claimed in claim 6, and further comprising mechanical setting means including a winding stem, said stem extending longitudinally within and without said movement, said setting means being on the side of said frame plate opposite said battery.

21. A quartz crystal watch as claimed in claim 20, wherein said gear train includes a plurality of interconnected wheels and pinions, said winding stem being radially oriented on said movement and the centers of said plurality of wheels being substantially on a line transverse to said stem, said transverse line being a secant of the circular area of said movement.

22. A quartz crystal watch as claimed in claim 21, wherein said circuit means and vibrator means are in a first circle portion, formed by said secant line, adjacent said stem, and said motor means are in a second circle portion formed by said secant line opposite from said stem.

23. A quartz crystal watch as claimed in claim 22, wherein said setting means are located within said first circle portion.

24. A quartz crystal watch as claimed in claim 23, wherein said plurality of wheels overlap a portion of said first circle portion.

25. A quartz crystal watch as claimed in claim 24, wherein each said wheel includes a toothed wheel, and at least one toothed wheel overlaps the rotational center of another toothed wheel.

26. A quartz crystal watch as claimed in claim 7, wherein said setting means further includes stem holding and clicking means, and a clutch wheel for time setting, and means for moving said clutch wheel, said clicking means operating independently of said means for moving said clutch wheel.

27. A quartz crystal watch as claimed in claim 26, wherein said clutch wheel is mounted for rotation with said stem and for translation along said stem, said means for moving said clutch wheel including two levers, each lever acting on an opposite face of said clutch wheel.

28. A quartz crystal watch as claimed in claim 27, wherein said movement includes a center wheel and said clutch wheel directly engages said center wheel for time setting.

* * * * *